US008459090B2

(12) United States Patent
Wilcox et al.

(10) Patent No.: US 8,459,090 B2
(45) Date of Patent: Jun. 11, 2013

(54) ROD BENDERS AND METHODS OF USE

(75) Inventors: Bryan Wilcox, Augustine, FL (US); Brian Butler, Atoka, TN (US)

(73) Assignee: Warsaw Orthopedic, Inc., Warsaw, IN (US)

( * ) Notice: Subject to any disclaimer, the term of this patent is extended or adjusted under 35 U.S.C. 154(b) by 0 days.

(21) Appl. No.: 13/272,521

(22) Filed: Oct. 13, 2011

(65) Prior Publication Data

US 2013/0091921 A1 Apr. 18, 2013

(51) Int. Cl.
*B21D 7/06* (2006.01)

(52) U.S. Cl.
USPC ..... 72/458; 72/479; 140/106

(58) Field of Classification Search
USPC ..... 72/457, 458, 479; 140/106
See application file for complete search history.

(56) References Cited

U.S. PATENT DOCUMENTS

| | | | | |
|---|---|---|---|---|
| 1,354,448 | A * | 9/1920 | Walt | 72/458 |
| 2,365,731 | A * | 12/1944 | Simons | 72/458 |
| 2,616,317 | A * | 11/1952 | Hakkerup | 72/458 |
| 4,474,046 | A | 10/1984 | Cook | |
| 5,161,404 | A | 11/1992 | Hayes | |
| 5,819,580 | A | 10/1998 | Gauthier | |
| 6,006,581 | A | 12/1999 | Holmes | |
| 7,454,939 | B2 | 11/2008 | Garner et al. | |
| 2006/0264973 | A1 | 11/2006 | Abdelgany | |

* cited by examiner

*Primary Examiner* — David B Jones

(57) ABSTRACT

A rod bender includes an elongated body having a proximal end and a distal end and extending along a longitudinal axis; a first arm having a proximal end attached to the distal end of the body and extending transversely therefrom and having a longitudinal axis offset from the longitudinal axis of the body; and a second arm having a proximal end attached to the distal end of the body and extending transversely therefrom and having a longitudinal axis offset from the longitudinal axis of the body and offset from the longitudinal axis of the first arm, said second arm including a channel positioned toward a distal end of said second arm, said channel having a longitudinal axis substantially perpendicular to the longitudinal axis of the second arm.

20 Claims, 5 Drawing Sheets

ROD BENDERS AND METHODS OF USE

TECHNICAL FIELD

The present disclosure generally relates to medical devices, systems and methods employed during surgical applications, and more particularly, to a surgical device that is configured to shape a spinal rod.

BACKGROUND

Spinal reconstruction often requires the implantation of support structures into a patient's body in order to reshape and provide support when spinal disorders and diseases have damaged sections of the spinal column. Certain reconstruction techniques used to provide spinal shape and support, include the use of spinal rods that are attached to bone anchors implanted into adjacent vertebrae of the spine of a patient. These rods often require bending during implantation in order to provide the proper shape of the spine and realignment of the vertebrae.

The materials that comprise these rods are required to be of sufficient hardness to withstand the stresses of spinal support but need to be capable of bending in the operating room to provide the required shape during the surgical procedure. With the use of Cobalt Chrome (CoCr) becoming more prevalent, different methods of bending the CoCr rod are needed to make the task easier on the surgeon.

Existing rod benders often require the use of two hands to manipulate the bender, leaving the rod to be held by a second person. A rod bender that requires the use of one hand can provide great benefit to a surgeon. This disclosure describes an improvement over these prior art technologies.

SUMMARY OF THE INVENTION

Accordingly, a rod bender, system and related methods are provided for employment during surgical applications. It is contemplated that the rod bender is configured to bend a spinal rod. It is also contemplated that the rod bender can be used in situ without requiring removal of the rod during a surgical procedure.

In one particular embodiment, in accordance with the principles of the present disclosure, a rod bender is provided. The rod bender includes an elongated body having a proximal end and a distal end and extending along a longitudinal axis. The rod bender also includes a first arm having a proximal end attached to the distal end of the body and extending transversely therefrom and having a longitudinal axis offset from the longitudinal axis of the body. The rod bender also includes a second arm having a proximal end attached to the distal end of the body and extending transversely therefrom and having a longitudinal axis offset from the longitudinal axis of the body and offset from the longitudinal axis of the first arm, said second arm including a channel positioned toward a distal end of said second arm, said channel having a longitudinal axis substantially perpendicular to the longitudinal axis of the second arm.

In one embodiment, the rod bender includes an elongated body having a proximal end and a distal end and extending along a longitudinal axis. The rod bender also includes a first arm having a proximal end attached to the distal end of the body and extending transversely therefrom and having a longitudinal axis offset from the longitudinal axis of the body. The rod bender further includes a second arm having a proximal end attached to the distal end of the body and extending transversely therefrom and having a longitudinal axis offset from the longitudinal axis of the body and offset from the longitudinal axis of the first arm. The rod bender also includes a flange positioned at a distal end of said second arm, said flange having a planer surface substantially perpendicular to the longitudinal axis of the second arm.

In one embodiment, a rod bending kit is provided. The rod bending kit includes a rod bender as described herein. The rod bending kit also includes at least one first arm extension attachable to said first arm and having a curvature radius on a distal end curved surface different from a curvature radius of a distal end of said first arm.

BRIEF DESCRIPTION OF THE DRAWINGS

The present disclosure will become more readily apparent from the specific description accompanied by the following drawings, in which.

Like reference numerals indicate similar parts throughout the figures.

DETAILED DESCRIPTION OF THE INVENTION

Figure 1:
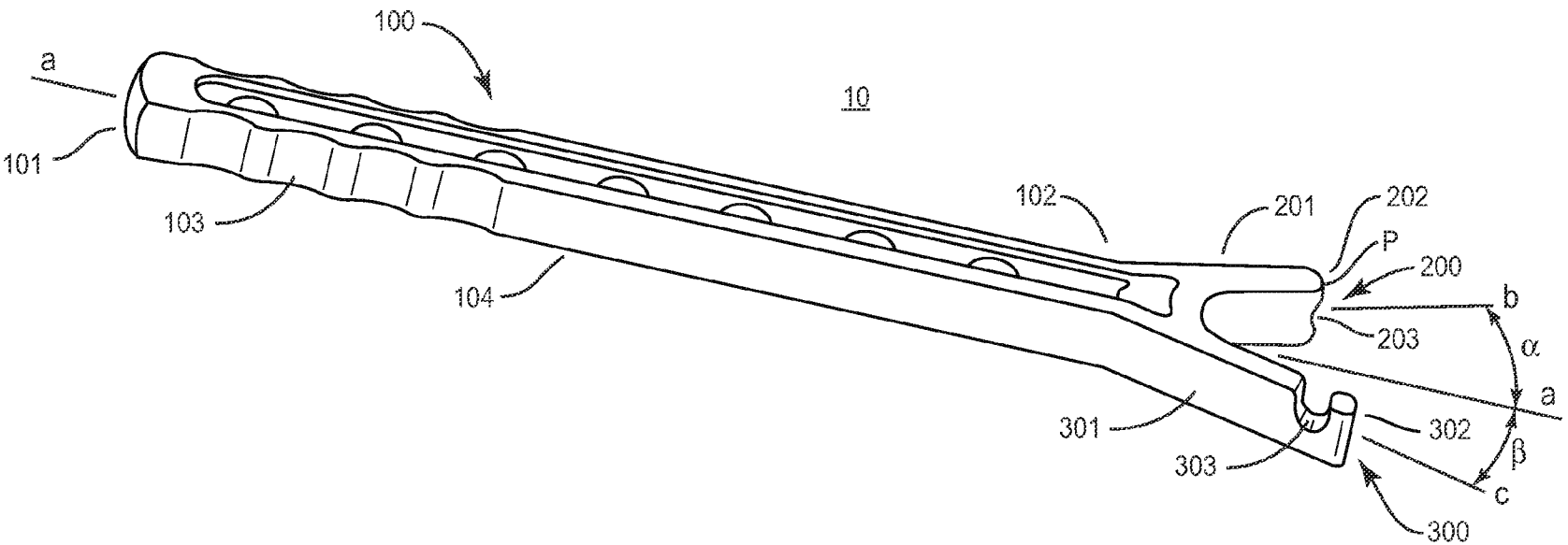
FIG. 1 is a perspective view of one particular embodiment of a rod bender in accordance with the principles of the present disclosure.

The exemplary embodiments of they rod bender, related systems and methods of use disclosed are discussed in terms of medical devices employed during surgical applications and more particularly, in terms of a rod bender configured to bend a spinal rod during surgical procedure. It is envisioned that the rod bender, systems and methods of use disclosed provide a reliable and single handed operation allowing a surgeon to use in situ or out of the patient.

It is envisioned that the present disclosure may be employed to treat spinal disorders such as, for example, degenerative disc disease, disc herniation, osteoporosis, spondylolisthesis, stenosis, scoliosis and other curvature abnormalities, kyphosis, tumor and fractures. It is contemplated that the present disclosure may be employed with other osteal and bone related applications, including those associated with diagnostics and therapeutics. It is further contemplated that the disclosed surgical assembly may be employed in a surgical treatment with a patient in a prone or supine position, and/or employ various surgical approaches to the spine, including anterior, posterior, posterior mid-line, lateral, postero-lateral, and/or antero-lateral approaches, and in other body regions. The present disclosure may be employed with procedures for treating the lumbar, cervical, thoracic and pelvic regions of a spinal column. The system and methods of the present disclosure may also be used on animals, bone models and other non-living substrates, such as for training, testing and demonstration.

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes Only and can be varied within the scope of the disclosure. For example, the references "upper" and "lower" are relative and used only in the context to the other, and are not necessarily "superior" and "inferior". Also, as used in the specification and including the appended claims, the term "tissue" includes soft tissue, ligaments, tendons, cartilage and/or bone unless specifically referred to otherwise.

The following discussion includes a description of a rod bender, related components and exemplary methods of employing the rod bender in accordance with the principles of the present disclosure. Alternate embodiments are also disclosed. Reference will now be made in detail to the exemplary embodiments of the present disclosure, which are illustrated in the accompanying figures. Turning now to FIGS. 1-5, there is illustrated components of a rod bender 10 in accordance with the principles of the present disclosure.

Figure 2B:
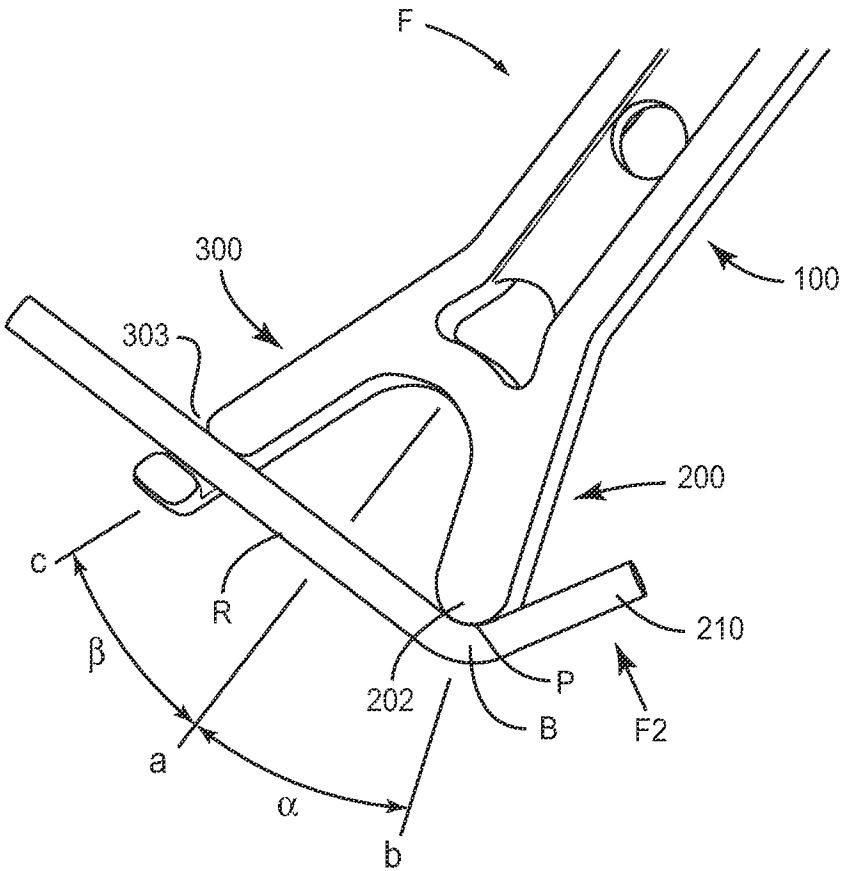
FIG. 2B is a cut away perspective view of the rod bender shown in FIG. 1 with a bended rod.

Rod bender 10 is in the shape of a "Y". Rod bender 10 includes a body 100, a first arm 200 and a second arm 300. The second arm 300 connects with a rod R to be bent, while the first arm 200 acts as a pivot point P at which the rod will bend when the proper force F is applied, as shown in FIG. 2B. As rod bender 10 is rotated about pivot point P, rod R will bend.

Body 100 includes a proximal end 101 and a distal end 102 having an elongated section 104 therebetween and extending along longitudinal axis a. First arm 200 includes a proximal end 201 and a distal end 202. Proximal end 201 of first arm 200 is attached to distal end 102 of body 100. Groove 203 is positioned at distal end 202 of arm 200. First arm 200 extends transversely from body 100 along longitudinal axis b. Second arm 300 includes a proximal end 301 and a distal end 302. Proximal end 301 of second arm 300 is also attached to distal end 102 of body 100. Second arm 300 extends transversely from body 100 along longitudinal axis c. Each of axes a, b, c preferably lie in the same plane. Axes a and b are offset from each other by angle ∀, and axes a and c are offset from each other by angle ∃. Angles ∀ and ∃ can but are not required to be equal to each other. Angles ∀ and ∃ can each range from 0 degrees to 60 degrees. Angles ∀ and ∃ are defined to provide an optimal bending forces to bend rod R. Groove 203 runs along distal end 202 transverse to axis b. In an embodiment, first arm 200 and second arm 300 are substantially equal in length.

Second arm 300 includes a channel 303 positioned toward distal end 302 of second arm 300. Channel 303 extends substantially perpendicular to axis c of second arm 300. Channel 303 has a width defined along axis c. The width of channel 303 is substantially equal to or greater than a diameter of a rod R to be bent, as will be described in further detail below. In an embodiment, a length of first arm 200 is substantially equal to a length from, proximal end 301 of second arm 300 to channel 303.

Rod bender 10 can also include a handle 103 positioned at proximal end 101 of body 100. Although handle 103 is shown in FIG. 1 as being monolithically formed with body 100, other handles are contemplated. For example, handle 103 can attach to and extend from proximal end 101 of body 100 using a screw and threaded bore arrangement. Or as another example, handle 103 can be a fitted slipcover that would slide over proximal end 101 of body 100. Other handle 103 configurations are contemplated.

Figure 2A:
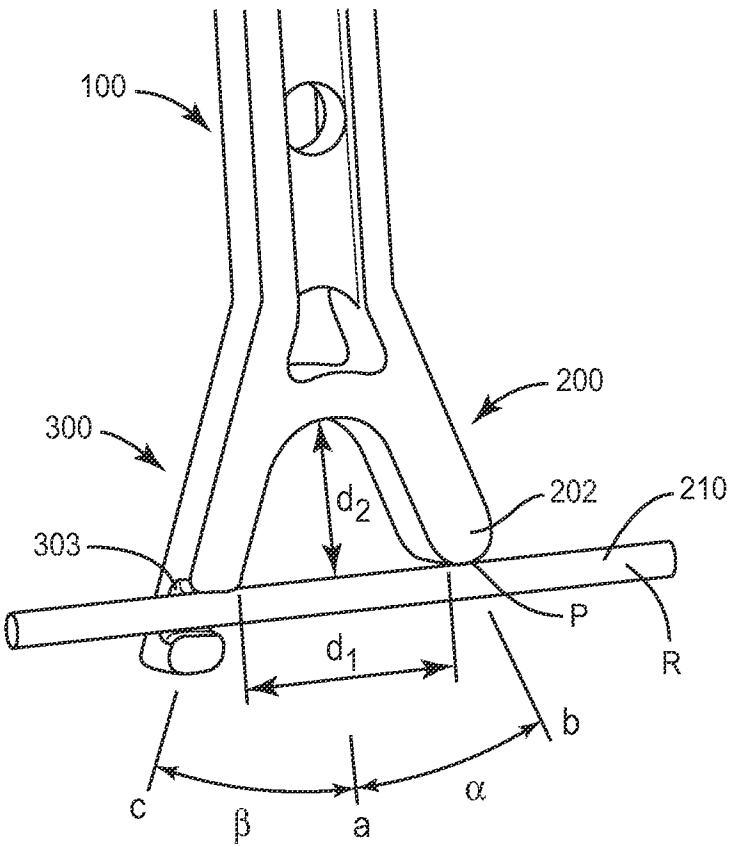
FIG. 2A is cut away perspective view of the rod bender shown in FIG. 1 with an unbended rod.

In use, as shown in FIGS. 2A and 2B, rod bender 10 can be used to bend a surgical rod R. Rod R is placed within channel 303 as shown. A point at which rod R is to be bent is approximately aligned with pivot point P. To stabilize rod R about pivot point P, rod R is positioned within groove 203. Rod R requires support force F2 at or about point 210 to provide leverage to counteract force F required to bend rod R. It is contemplated that force F is provided by manual manipulation of handle 103. It is also contemplated that support force F2 can be provided by a structure in the operating room, for example, but not limited to, a table, a vice or the floor. Support force F2 can also be provided in situ by a bone screw anchor that has been inserted into a bone of the patient. As force F is applied in the direction shown, a translated force will be applied to that portion of rod R in channel 303. In turn support force F2 will prevent point 210 from rotating with force F, and rod R will bend about pivot point P. When a proper bend is achieved, force F is withdrawn and the bending is stopped. Further bending can proceed if and as required.

As shown in FIG. 2, first arm 200 and second arm 300 defines a distance d1 along rod R and a distance d2 between distal end 102 of body 100 and rod R. In an embodiment, when the rod bender 10 is used to bend rod R in situ in conjunction with surgery utilizing bone anchors, rod bender 10 can be designed to define distances d1 and d2 to provide adequate clearance to span a bone screw anchor (not shown). For example, if rod bender 10 is to be used with a bone screw anchor having a head width of 8 millimeters (mm) and depth 5 mm, distance d1 should be greater than 8 mm and distance d2 be greater than 5 mm. This design allows for rod bender 10 to have sufficient clearance about the bone screw anchor to properly bend a rod using rod bender 10. Further, this design allows for rod bender 10 to be used even after rod R is secured to a bone screw anchor that has been attached to a bone within a patient, in, for example, an effort to properly align adjacent vertebrae.

Figure 3B:
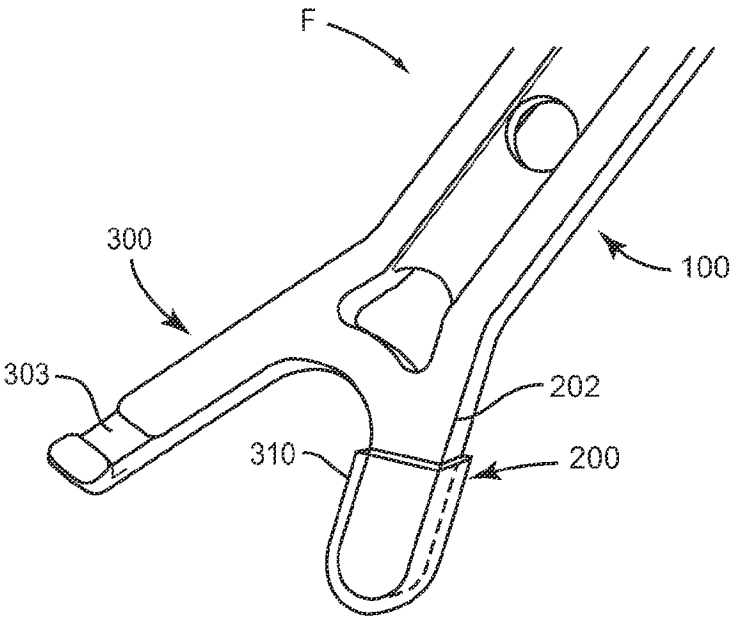
FIG. 3B is a cut away perspective view of the rod bender shown in FIG. 1 and a first arm extension attached thereto.
Figure 3A:
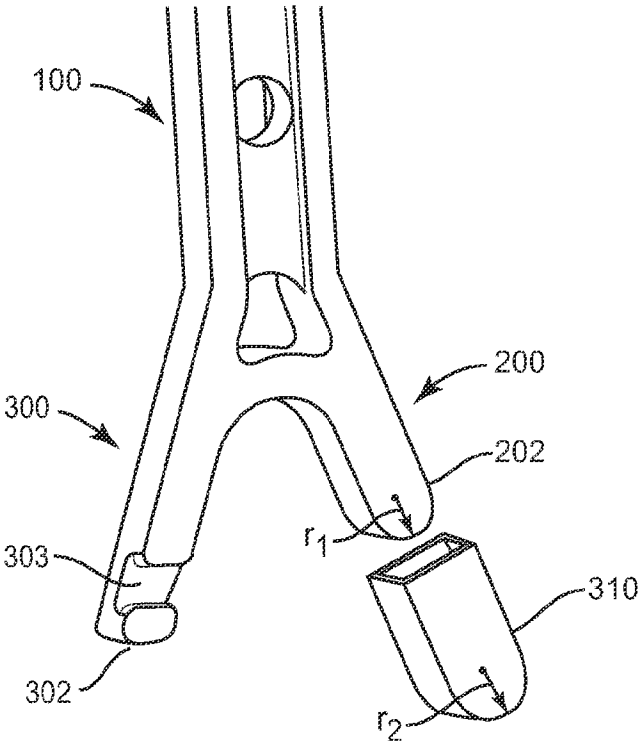
FIG. 3A is a cut away perspective view of the rod bender shown in FIG. 1 and a first arm extension.

A curvature radius of a bend produced in rod R by rod bender 10 is defined, at least in part, by a curvature radius r1 of a curved end of distal end 202 of first arm 200, as shown in FIG. 3A. A smaller curvature radius r1 will produce a smaller curvature radius in the bend in rod R produced by rod bender 10; a larger curvature radius r1 will produce a larger curvature radius in the bend in rod R produced by rod bender 10. As shown in FIGS. 3A and 3B, in an embodiment of the present invention, one or more interchangeable first arm extensions 310 can be provided. Each extension 310 has a curvature radius r2 that differs from curvature radius r1 of first arm 200. If more than one extension 310 is provided, the curvature radius of each extension 310 would also differ from each other. In addition, each first arm extension 310 can include a groove (not shown) to stabilize the rod during bending as described above.

Each extension 310 can be attached to first arm 200 to change the curvature radius r1 of first arm 200. In this embodiment, extension 310 is shown as a type of slip cover that securely fits over first arm 200. Since curvature radius r2 is greater than curvature radius r1, a bend in rod R produced with extension 310 in place will have a greater curvature radius than a bend produced by rod bender 10 without the use of extension 310. It is contemplated that distal end of first arm 200 and/or extensions 310 can also have differing shapes that would produce different bends in rod R. For example, if first arm 200 and/or extension 310 is provided with a point in place of the curved surface, a bend produced in rod R will include a sharp angle crease. In another example, if first arm 200 and/or extension 310 included a squared end, a bend produced in rod R will have a square-like shape with 2 sharp angle creases. Other shapes and sizes of first arm 200 and/or extension 310 are contemplated.

It is also contemplated that extensions 310 can have different means for attachment to rod bender 10. For example, in one embodiment, first arm 200 can be attached to body 100 via a post and socket configuration. In this configuration, first arm can be detachable from body 100 by sliding the post from the socket. A plurality of extenders 310 in the form of replacement first arms can be provided, each having a post or socket, as the design may warrant, and can be attached to body 100 by sliding the post into the socket. Other means for connecting first arms are contemplated.

Figure 4:
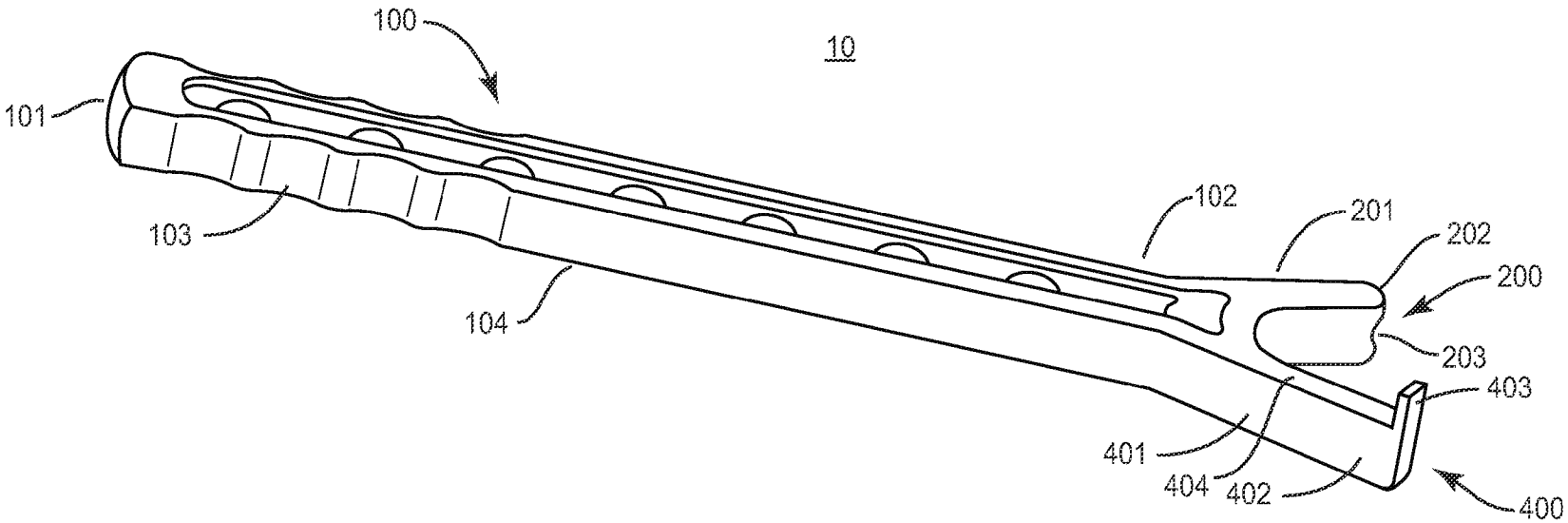
FIG. 4 is a perspective view of one particular embodiment of a rod bender in accordance with the principles of the present disclosure.
Figure 5B:
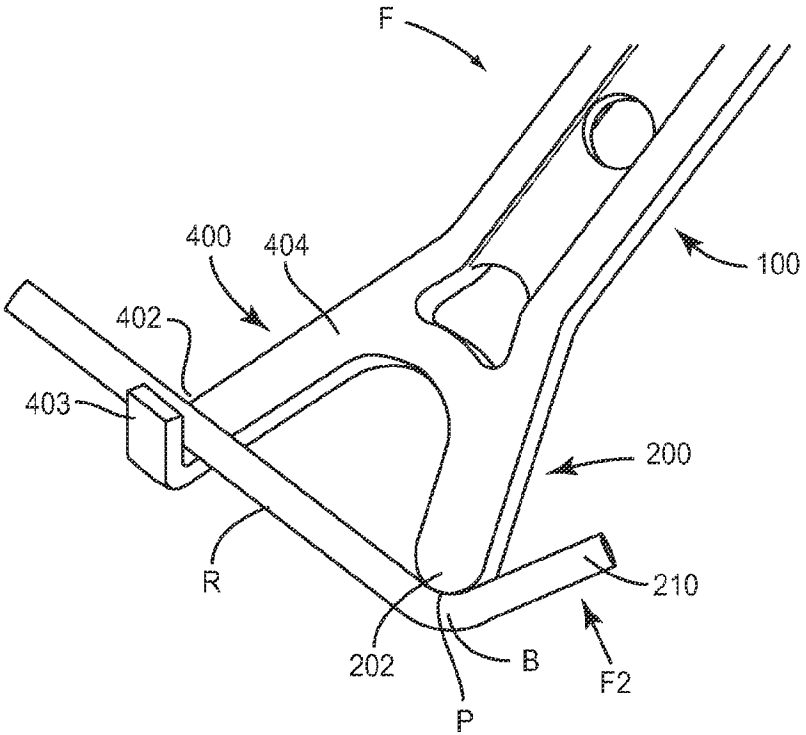
FIG. 5B is a cut away perspective view of the rod bender shown in FIG. 4 with a bended rod.
Figure 5A:
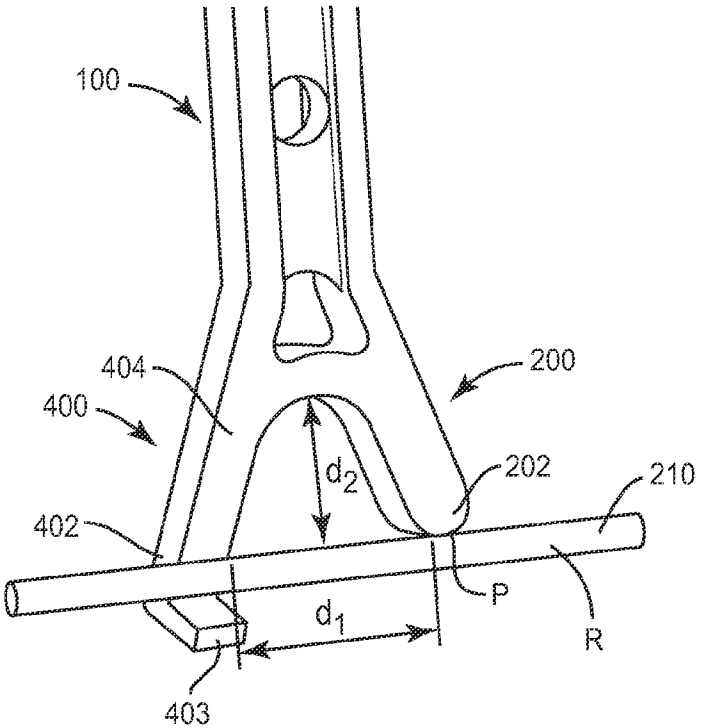
FIG. 5A is cut away perspective view of the rod bender shown in FIG. 4 with an unbended rod.

In an embodiment shown in FIGS. 4, 5A and 5B, second arm 400 includes a proximal end 401 and a distal end 402. Proximal end 401 of second arm 400 is also attached to distal end 102 of body 100. Second arm 400 extends transversely from body 100, is a similar fashion as previously described. A flange 403 is positioned at distal end 402 of second arm 400. In this embodiment, no channel 303 is provided. The other features of rod bender 10 remain the same as those shown in FIGS. 1-3. Second arm 400 defines a planar face 404. A planar surface of flange 403 extends substantially perpendicular to planar face 404. Flange 403 must be long enough to maintain contact with rod R during the bending process such that rod R does not slip off of flange during the bending process. A length of flange 403 required is defined by the size of a rod R to be bent. Like channel 303, flange 403 provides the needed translated force to rod R during the bending process, as detailed below.

In use, as shown in FIGS. 5A and 58, rod bender 10 can be used to bend a surgical rod R. Rod R is placed on flange 403 as shown. A point at which rod R is to be bent is approximately aligned with pivot point P. Rod R requires support force F2 at or about point 210 to provide leverage to counteract force F required to bend rod R. It is contemplated that force F is provided by manual manipulation of handle 103. It is also contemplated that support force F2 can be provided by a structure in the operating room, for example, but not limited to, a table, a vice or the floor. Support force F2 can also be provided in situ by a bone screw anchor that has been inserted into a bone of the patient. As force F is applied in the direction shown a translated force will be applied to that portion of rod R in contact with flange 403. In turn support force F2 will prevent point 210 from rotating with force F, and rod R will bend about pivot point P. When a proper bend is achieved, force F is withdrawn and the bending is stopped. Further bending can proceed if and as required.

It is also contemplated that the plurality of extensions 310, detailed above, can be utilized with the rod bender 10 shown in FIG. 4. It is also contemplated that the various other extension 310 embodiments detailed above can be utilized with rod bender 10 of FIG. 4.

A kit for bending a rod is also contemplated. The kit for bending a rod can include a rod bender 10 as described herein. The kit can also include one or more first arm extensions 310 attachable to first arm 200 as described above. It is also contemplated that the kit can include one or more replacement first arms 200 as described herein.

Rod bender 10 may be employed during spinal surgeries, such as, for example, discectomy, laminectomy, fusion, laminotomy, laminectomy, nerve root retraction, foramenotomy, facetectomy, decompression, spinal nucleus or disc replacement and bone graft and implantable prosthetics including plates and bone engaging fasteners.

According to one embodiment, the rod bender and all of its components, including extensions and replacement first arms, are made of an autoclavable material. That is, a material capable of withstanding high temperatures and pressures used to sterilize surgical materials. As such, the surgical tool typically includes a metal, metal alloy, polymer, or ceramic material. According to one embodiment, suitable metal and metal alloys can include transition metals. In a particular embodiment, the surgical tool can include iron (e.g., steel), titanium, nickel, chromium, cobalt, tungsten, molybdenum, vanadium, and any combination thereof. Moreover, components of the surgical tool described herein can include ceramic materials, such that the entire component includes a ceramic, or more particularly the component includes a ceramic coating. In one embodiment, suitable ceramics can include oxides, carbides, borides, nitrides, or any combination thereof. Still, in one particular embodiment, the surgical tool includes oxides such as, silica, alumina, zirconia, titania, and the like, and any combinations thereof.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

What is claimed is:

1. A rod bender, comprising:

an elongated body having a proximal end and a distal end and extending along a longitudinal axis;

a first arm having a proximal end attached to the distal end of the body and extending transversely therefrom and having a longitudinal axis offset from the longitudinal axis of the body, a distal end of the first arm including a curved surface that defines a curvature radius of a bend made in a rod;

a second arm having a proximal end attached to the distal end of the body and extending transversely therefrom and having a longitudinal axis offset from the longitudinal axis of the body and offset from the longitudinal axis of the first arm, said second arm including a channel positioned toward a distal end of said second arm, said channel having a longitudinal axis substantially perpendicular to the longitudinal axis of the second arm; and at least one interchangeable first arm extension attachable to said first arm and having a curvature radius on a distal end curved surface different from said curvature radius of said first arm.

2. The rod bender of claim 1, wherein an offset angle between the longitudinal axis of the first arm and the longitudinal axis of the second arm is less than 120 degrees.

3. The rod bender of claim 1, wherein a length of the first arm is substantially equal to a length of the second arm.

4. The rod bender of claim 1, wherein a length of the first arm is substantially equal to a length from the proximal end of the second arm to the channel of the second arm.

5. The rod bender of claim 1, wherein a width of the channel is greater than or equal to a diameter of a rod to be bent.

6. The rod bender of claim 1, wherein said body includes a handle positioned at the proximal end of the body.

7. The rod bender of claim 6, wherein the handle is monolithically formed with the body.

8. The rod bender of claim 6, wherein the handle comprises fitted slip cover that slides over said proximal end of said body.

9. The rod bender of claim 1, wherein the longitudinal axes lie in the same plane.

10. The rod bender of claim 1, wherein an offset angle between the longitudinal axis of the body and the longitudinal axis of the first arm ranges from 0 degrees to 60 degrees.

11. The rod bender of claim 1, wherein an offset angle between the longitudinal axis of the body and the longitudinal axis of the second arm ranges from 0 degrees to 60 degrees.

12. The rod bender of claim 1, wherein an offset angle between the longitudinal axis of the body and the longitudinal axis of the first arm is equal to an offset angle between the longitudinal axis of the body and the longitudinal axis of the second arm.

13. The rod bender of claim 1, wherein an offset angle between the longitudinal axis of the body and the longitudinal axis of the first arm is different than an offset angle between the longitudinal axis of the body and the longitudinal axis of the second arm.

14. A rod bender, comprising:

an elongated body having a proximal end and a distal end and extending along a longitudinal axis;

a first arm having a proximal end attached to the distal end of the body and extending transversely therefrom and having a longitudinal axis offset from the longitudinal axis of the body, a distal end of the first arm includes a curved surface that defines a curvature radius of a bend made in a rod;

at least one first arm extension attachable to said first arm and having a curvature radius on a distal end curved surface different from said curvature radius of said first arm;

a second arm having a proximal end attached to the distal end of the body and extending transversely therefrom and having a longitudinal axis offset from the longitudinal axis of the body and offset from the longitudinal axis of the first arm; and a flange positioned at a distal end of said second arm, said flange having a planer surface substantially perpendicular to the longitudinal axis of the second arm.

15. The rod bender of claim 14, wherein an offset angle between the longitudinal axis of the first arm and the longitudinal axis of the second arm is less than 120 degrees.

16. The rod bender of claim 14, wherein a length of the first arm is substantially equal to a length of the second arm.

17. The rod bender of claim 14, wherein said flange is configured to maintain contact with a rod during a bending process.

18. The rod bender of claim 14, wherein said body includes a handle positioned at the proximal end of the body.

19. The rod bender of claim 18, wherein the handle is monolithically formed with the body.

20. A kit for bending a rod, comprising:

a rod bender according to claim 1;

wherein said first arm extension comprises a plurality of first arm extensions each having a curvature radius on a distal end curved surface that is different from the curvature radius on the distal end curved surface of another first arm extension, the curvature radius of each first arm extension being different from said curvature radius of said first arm.

* * * * *